US008486881B2

(12) United States Patent
Borchers et al.

(10) Patent No.: US 8,486,881 B2
(45) Date of Patent: Jul. 16, 2013

(54) BLEACH GRANULES COMPRISING AN ACTIVE COATING

(75) Inventors: Georg Borchers, Bad Nauheim (DE); Gerd Reinhardt, Kelkheim (DE); Andreas Schottstedt, Hofheim (DE)

(73) Assignee: Clariant Finance (BVI) Limited, Tortola (VG)

( * ) Notice: Subject to any disclaimer, the term of this patent is extended or adjusted under 35 U.S.C. 154(b) by 52 days.

(21) Appl. No.: 13/263,028

(22) PCT Filed: Apr. 1, 2010

(86) PCT No.: PCT/EP2010/002100

§ 371 (c)(1), (2), (4) Date: Nov. 29, 2011

(87) PCT Pub. No.: WO2010/115582

PCT Pub. Date: Oct. 14, 2010

(65) Prior Publication Data

US 2012/0058927 A1 Mar. 8, 2012

(30) Foreign Application Priority Data

Apr. 11, 2009 (DE) ..... 10 2009 017 722

(51) Int. Cl.

| | |
|---|---|
| ***C11D 7/32*** | (2006.01) |
| ***C11D 7/54*** | (2006.01) |
| ***C11D 17/00*** | (2006.01) |

(52) U.S. Cl.

USPC ..... 510/224; 510/311; 510/312; 510/313; 510/349; 510/376; 510/441; 510/488; 510/499; 510/501

(58) Field of Classification Search

USPC ..... 510/224, 311, 312, 313, 349, 376, 510/441, 488, 499, 501; 252/186.33

See application file for complete search history.

(56) References Cited

U.S. PATENT DOCUMENTS

| | | | |
|---|---|---|---|
| 6,875,734 | B2 | 4/2005 | Reinhardt et al. |
| 7,094,745 | B2 | 8/2006 | Jonas et al. |
| 7,205,267 | B2 | 4/2007 | Reinhardt et al. |
| 2012/0094889 | A1 | 4/2012 | Borchers et al. |

FOREIGN PATENT DOCUMENTS

| | | |
|---|---|---|
| EP | 0458397 | 11/1991 |
| EP | 0458398 | 11/1991 |
| EP | 0530870 | 3/1993 |
| EP | 0544440 | 6/1993 |
| EP | 0549272 | 6/1993 |
| EP | 0616029 | 9/1994 |
| EP | 0710714 | 5/1996 |
| EP | 1499702 | 11/2003 |
| EP | 1445305 | 8/2004 |
| EP | 1520910 | 4/2005 |
| EP | 1557457 | 7/2005 |
| WO | WO 95/06710 | 3/1995 |
| WO | WO 95/06711 | 3/1995 |
| WO | WO 96/06154 | 2/1996 |
| WO | WO 96/06157 | 2/1996 |
| WO | WO 03/093405 | 11/2003 |
| WO | WO 2006/125517 | 11/2006 |
| WO | WO 2008/069935 | 6/2008 |

OTHER PUBLICATIONS

International Search Report for PCT/EP2010/002099, dated Jul. 6, 2010.

Translation of International Preliminary Report on Patentability for PCT/EP2010/0209, dated Jul. 5, 2011.

International Search Report for PCT/EP2010/002100, dated Jun. 25, 2010.

Translation of International Preliminary Report on Patentability for PCT/EP2010/0209, dated Jul. 22, 2011.

*Primary Examiner* — Gregory Delcotto

(74) *Attorney, Agent, or Firm* — Tod A. Waldrop

(57) ABSTRACT

The invention relates to co-granules containing a granule core and a sheath or coating layer surrounding the granule core. Said co-granules are characterized in that the granule core contains a) at least one bleach activator, a2) between 0 and 20 wt. % of the total quantity of at least one bleach catalyst contained in the co-granule, and c) at least one binding agent, and the sheath or coating layer contains d) between 80 and 100 wt. % of the total quantity of the at least one bleach catalyst contained in the co-granule, and e) at least one coating agent. The co-granules are advantageously suitable for producing cleaning products and detergents and especially products for washing crockery in a machine.

11 Claims, No Drawings

BLEACH GRANULES COMPRISING AN ACTIVE COATING

The present invention relates to bleach granules, to a method for their production, and to their use in detergents and cleaners, in particular in compositions for machine dishwashing.

In order to obtain spotless dishes, persalts such as perborates and percarbonates are used in machine dishwashing detergents. To activate these bleaches and in order to achieve an improved bleaching effect when washing at temperatures of 60° C. and below, machine dishwashing detergents generally also comprise bleach activators or bleach catalysts, with the bleach catalysts in particular having proven to be particularly effective.

Bleach catalysts are used in machine dishwashing compositions preferably in the form of pre-fabricated granules in order to increase their storage stability. For example, EP 0 458 397, EP 0 458 398 and EP 0 530 870 describe bleach catalysts based on various manganese-containing transition metal complexes.

Methods for producing bleach catalyst granules are disclosed in EP 0 544 440, WO 95/06710 and WO 2008/069935. A characteristic feature of the method described therein is the use of large amounts of inert materials as supports, and also binders, which are optionally used as melts, this procedure including cooling and/or drying stages, which necessitates the use of additional apparatuses such as fluidized-bed plants.

The germ-killing effect of bleach catalysts, however, is in most cases low. The performance of bleaches in machine dishwashing detergents is therefore higher if they consist of a combination of a bleach catalyst with a bleach activator. Here, the bleaching effect of the catalyst is effectively supported by the peroxycarboxylic acid formed from the activator. At the same time, the peroxycarboxylic acid contributes significantly to the germ killing on the washware, improves the odor of the wash liquor and prevents the formation of a biofilm in the dishwasher. The combination of bleach catalysts and bleach activators is therefore useful for increasing the bleaching performance and ensuring hygiene when using bleaches in detergents and cleaners. For example, EP 0 616 029 describes a bleach additive consisting of a dry mixture of percarbonate, TAED granules and bleach catalyst granules. In this case too, the bleach catalyst granules only have an active content of 1.2% by weight, the remainder consists of support materials and/or binder.

However, the use of activators and catalysts in separate granules offers disadvantages which can have an adverse effect on the bleaching performance. The reactions of the persalt, and/or of the hydrogen peroxide released therefrom with activator and catalyst proceed in parallel. If the catalyst granules dissolve more rapidly than the activator granules, the persalt is already used up before it can react with the activator. The same applies to the converse case. Cogranules of activators and catalysts are also advantageous for ensuring the homogeneous distribution of both components in the detergent and cleaner and in order to save space in the formulation. Furthermore, the manufacturing costs are lower since only one set of cogranules has to be produced instead of two different sets of granules.

EP 1 499 702 describes cogranules consisting of a bleach catalyst, a bleach activator and, if desired, a coating. Optionally, stabilizers such as antioxidants, reducing agents or acids may be present in amounts up to 2.5% by weight.

In this and other production processes known in the literature for activator/catalyst cogranules, bleach activator and catalyst are present in the granules spatially alongside one another. If the granules dissolve during the washing process, in the event of an equal dissolution rate of the components, activator and catalyst should be dissolved in the same quantitative ratio and be available for the reaction with hydrogen peroxide, released from a persalt. The reactions then proceed in parallel and activator and catalyst thus participate in the bleaching process in the same quantitative ratio. This is not the case when the dissolution rate of one of the two components, activator or catalyst, is delayed, which often occurs. If the dissolution rate of the catalyst is considerably lower than that of the activator, the hydrogen peroxide, or the persalt, is already used up as a result of reaction with the activator, meaning that no hydrogen peroxide, or only a minor amount of hydrogen peroxide, is available for the reaction with the catalyst. As already indicated above, however, the catalyst is primarily responsible for the low-temperature bleaching performance, and the activator is in particular responsible for the hygiene during the bleaching process. The focus of new bleach granules lies primarily in the area of low-temperature bleaching.

There is therefore a need for new types of detergent granules which have good low-temperature performance and only in a second respect ensure the hygiene aspect and the mid-temperature performance. It must therefore be ensured that activator/catalyst cogranules dissolve such that firstly the catalyst, and in a second step the activator, is released in the wash liquor. This requirement is not met by the prior art.

The object of the present invention was therefore to provide bleach activator/bleach catalyst cogranules which, compared with granules known from the prior art, are characterized in that during use in the wash liquor, firstly the catalyst and then, in a second step, the activator is released. Surprisingly, the object set could be achieved by providing activator/catalyst cogranules in which the activator is present in the granule core, preferably in particle form, and ≧80% by weight of the amount of catalyst is present in a coating layer, preferably in dissolved form and/or in particle form.

The present invention therefore provides cogranules which comprise a granule core and a shell layer or coating layer surrounding the granule core, characterized in that the granule core comprises one or more bleach activators, 0-20% by weight of the total amount of bleach catalyst and one or more binders, and the shell layer or coating layer comprises 80-100% by weight of the total amount of bleach catalyst and one or more coating agents.

In these cogranules according to the invention, the granule core can optionally comprise one or more additives, preferably one or more organic acids. The shell layer or coating layer can optionally comprise one or more further additives and optionally one or more dyes.

Preferably, the granule core of the cogranules according to the invention comprises a) 1 to 99% by weight, preferably 69.1 to 99% by weight and particularly preferably 70 to 99% by weight, of one or more bleach activators and c) 0.9 to 30% by weight and preferably 1 to 30% by weight of one or more binders and the shell layer or coating layer of the cogranules according to the invention comprises d) 1 to 99% by weight, preferably 1 to 98.9% by weight and particularly preferably 1 to 98.8% by weight, of one or more bleach catalysts, and e) 1 to 99% by weight, preferably 1 to 98.9% by weight and particularly preferably 1 to 98.8% by weight, of one or more coating agents.

In the cogranules according to the invention that have just been specified, the granule core can optionally comprise one or more organic acids, preferably in an amount of from 0 to 30% by weight and particularly preferably in an amount of from 0.1 to 30% by weight.

In the cogranules according to the invention that have just been specified, the shell layer or coating layer can optionally comprise one or more further additives, preferably in an amount of from 0 to 30% by weight and particularly preferably in an amount of from 0.1 to 30% by weight.

In the cogranules according to the invention that have just been specified, the shell layer or coating layer can optionally also comprise one or more dyes, preferably in an amount of from 0 to 5% by weight and particularly preferably in an amount of from 0.1 to 5% by weight.

Particularly preferably, the granule core of the cogranules according to the invention comprises a) 50 to 95% by weight, preferably 79.9 to 95% by weight and particularly preferably 80 to 95% by weight, of one or more bleach activators and c) 4.9 to 20% by weight, preferably 5 to 20 and particularly preferably 5 to 15% by weight of one or more binders, and the shell layer or coating layer of the cogranules according to the invention comprises d) 2 to 60% by weight, preferably 2 to 59.9% by weight and particularly preferably 2 to 59.8% by weight, of one or more bleach catalysts and e) 40 to 98% by weight, preferably 40 to 97.9% by weight and particularly preferably 40 to 97.8% by weight of one or more coating agents.

In the cogranules according to the invention that have just been specified, the granule core can optionally comprise one or more organic acids, preferably in an amount of from 0 to 10% by weight and particularly preferably in an amount of from 0.1 to 10% by weight.

In the cogranules according to the invention that have just been specified, the shell layer or coating layer can optionally comprise one or more further additives, preferably in an amount of from 0 to 15% by weight, particularly preferably in an amount of from 0.1 to 15% by weight and particularly preferably in an amount of from 5 to 15% by weight.

In the cogranules according to the invention that have just been specified, the shell layer or coating layer can optionally also comprise one or more dyes, preferably in an amount of from 0 to 5% by weight and particularly preferably in an amount of from 0.1 to 5% by weight.

The quantitative data given above for the bleach activators of component a) and the binders of component c) and also the organic acids optionally present in the granule core of the cogranules according to the invention are based on the total amount of the granule core of the cogranules according to the invention. By contrast, the quantitative data given above for the bleach catalysts of component d), the coating agents of component e) and also the further additives and dyes optionally present in the shell layer or coating layer of the cogranules according to the invention are based on the total amount of the shell layer or coating layer of the cogranules according to the invention.

Preferred cogranules according to the invention are characterized in that the granule core comprises 0% by weight of the total amount of the one or more bleach catalysts present in the cogranules, and the shell layer or coating layer comprises 100% by weight of the total amount of the one or more bleach catalysts present in the cogranule.

The weight ratio of granule core to shell layer or coating layer is preferably from 95:5 to 50:50.

The weight ratio of granule core to shell layer or coating layer is particularly preferably from 90:10 to 60:40.

Bleach Activators

As bleach activators, the granules according to the invention can comprise polyacylated alkylenediamines, in particular tetraacetylethylenediamine (TAED), acylated triazine derivatives, in particular 1,5-diacetyl-2,4-dioxo-hexahydro-1,3,5-triazine (DADHT), acylated glycolurils, in particular tetraacetylglycoluril (TAGU), N-acylimides, in particular N-nonanoyl-succinimide (NOSI), acylated phenolsulfonates, in particular n-nonanoyl-oxy- or n-lauroyloxybenzenesulfonate, (NOBS or LOBS), acylated phenol-carboxylic acids, in particular nonanoyloxy- or decanoyloxybenzoic acid (NOBA or DOBA), carboxylic anhydrides, in particular phthalic anhydride, acylated polyhydric alcohols, in particular triacetin, ethylene glycol diacetate and 2,5-diacetoxy-2,5-dihydrofuran, and also acetylated sorbitol and mannitol or mixtures thereof (SORMAN), acylated sugar derivatives, in particular pentaacetylglucose (PAG), pentaacetylfructose, tetraacetylxylose and octaacetyllactose, and also acetylated, optionally N-alkylated glucamine and gluconolactone, and/or N-acylated lactams, for example N-benzoylcaprolactam. Hydrophilically substituted acylacetals and acyllactams are likewise preferably used. In addition, nitrile derivatives such as n-methyl-morpholinium acetonitrile methylsulfate (MMA) or cyanomorpholine (MOR) can be used as bleach activators. Combinations of conventional bleach activators can also be used. Particularly preferred bleach activators are TAED and DOBA.

Bleach Catalysts

Within the context of the present invention, the bleach catalysts used are preferably bleach-boosting transition metal salts and/or complexes of manganese, iron, cobalt, ruthenium, molybdenum, titanium or vanadium.

When using metal salts, preference is given in particular to manganese salts in oxidation states +2 or +3, for example manganese halides, with preference being given to the chlorides, manganese sulfates, manganese salts of organic acids such as manganese acetates, manganese acetyl-acetonates, manganese oxalates and also manganese nitrates.

Preference is also given to complexes of iron in oxidation states II or III and manganese in oxidation states II, III, IV or IV, which preferably comprise one or more macrocyclic ligand(s) with the donor functions N, NR, PR, O and/or S. Preference is given to using ligands which have nitrogen donor functions.

As transition metal complexes in the cogranules according to the invention, preference is given to using complexes which comprise, as macro-molecular ligands, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (MeMeTACN) and/or 2-methyl-1,4,7-triazacyclononane (Me/TACN) or bridged ligands such as 1,2-bis(4,7-dimethyl-1,4,7-triazacyclonono-1-yl)-ethane (Me4-DTNE) or derivatives of the cyclam or cyclen, such as 1,8-dimethylcyclam, 1,7-dimethylcyclen, 1,8-diethylcyclam, 1,7-diethylcyclen, 1,8-dibenzylcyclam and 1,7-dibenzylcyclen, as are described, e.g. in EP 0 458 397, EP 0 458 398, EP 0 549 272, WO 96/06154, WO 96/06157 or WO 2006/125517, but in addition also manganese complexes, as are known from EP 1 445 305, EP 1 520 910 or EP 1 557 457.

Suitable manganese complexes are, for example, $[Mn^{III}_2(\mu\text{-}O)_1(\mu\text{-}OAc)_2(TACN)_2](PF_6)_2$, $[Mn^{IV}_2(\mu\text{-}O)_3(Me\text{-}TACN)_2](PF_6)_2$, $[Mn^{IV}_2(\mu\text{-}O)_3(Me\text{-}TACN)_2](SO_4)$, $[Mn^{IV}_2(\mu\text{-}O)_3(Me\text{-}TACN)_2](OAc)_2$, $[Mn^{IV}_2(\mu\text{-}O)_3(Me\text{-}TACN)_2](Cl)_2$, $[Mn^{IV}_2(\mu\text{-}O)_3(Me4\text{-}DTE)](PF_6)_2$, $[Mn^{IV}_2(\mu\text{-}O)_3(Me4\text{-}DTE)]Cl_2$, $[Mn^{IV}_2(\mu\text{-}O)_3(Me4\text{-}DTE)](SO_4)$, $[Mn^{IV}_2(\mu\text{-}O)_3(Me4\text{-}DTE)](OAc)_2$, cis(1,4,8,11-tetraazacyclotetradecane)- dichloroiron(III) chloride, trans(1,4,8,11-tetraazacyclotetradecane)-dichloroiron(III) chloride, 1,8-diethyl-1,4,8,11-tetraazacyclotetradecane-iron(II) chloride, 1,8-diethyl-1,4,8,11-tetraazacyclotetradecane-manganese (II) chloride and 1,4,8,11-tetraazacyclotetradecane-manganese(II) chloride.

Particularly preferred metal-containing bleach catalysts are selected from manganese salts and manganese complexes, where, among the manganese salts, preference is in turn given to salts selected from manganese sulfate, manganese acetate and manganese oxalate; and, among the manganese complexes, preference is in turn given to complexes selected from $[Mn^{III}_2(\mu\text{-}O)_1(\mu\text{-}OAc)_2(TACN)_2](PF_6)_2$, $[Mn^{IV}_2(\mu\text{-}O)_3(Me\text{-}TACN)_2](PF_6)_2$, $[Mn^{IV}_2(\mu\text{-}O)_3(Me\text{-}TACN)_2](SO_4)$, $[Mn^{IV}_2(\mu\text{-}O)_3(Me\text{-}TACN)_2](OAc)_2$, $[Mn^{IV}_2(\mu\text{-}O)_3(Me\text{-}TACN)_2](Cl)_2$, $[Mn^{IV}_2(\mu\text{-}O)_3(Me4\text{-}DTE)](PF_6)_2$, $[Mn^{IV}_2(\mu\text{-}O)_3(Me4\text{-}DTE)]Cl_2$, $[Mn^{IV}_2(\mu\text{-}O)_3(Me4\text{-}DTE)](SO_4)$, $[Mn^{IV}_2(\mu\text{-}O)_3(Me4\text{-}DTE)](OAc)_2$, cis(1,4,8,11-tetraazacyclotetradecane)dichloroiron(III) chloride, trans (1,4,8,11-tetraazacyclotetradecane)dichloroiron(III) chloride, 1,8-diethyl-1,4,8,11-tetraazacyclotetradecaneiron (II) chloride, 1,8-diethyl-1,4,8,11-tetraazacyclotetradecane-manganese(II) chloride and 1,4,8,11-tetraazacyclotetradecanemanganese(II) chloride.

Organic Acids

As organic acid, it is possible to use either monomeric or polymeric acids, either in the form of the free acid or in partially neutralized form. Within the context of the present invention, the term "organic acid" therefore includes both the organic acids in free form and also in partially neutralized form.

As counterions, preference is given to Na ions.

Preferred organic acids are citric acid, ascorbic acid, oxalic acid, adipic acid, succinic acid, glutaric acid, malic acid, tartaric acid, maleic acid, fumaric acid, sugar acids, aminocarboxylic acids, fatty acids, and also mixtures of these. Particularly preferred organic acids are oxalic acid, ascorbic acid, citric acid and fatty acids. The polymeric acids used are polymers of acrylic acid and also copolymers of acrylic acid with methacrylic acid and of acrylic acid or methacrylic acid with maleic acid.

Particularly preferred organic acids are citric acid, ascorbic acid and oxalic acid.

Binders

As further ingredient, the cogranules according to the invention comprise one or more binders in order to ensure the cohesion of the cogranules.

Binders which can be used are preferably substances selected from fatty acids, alcohol ethoxylates, polymers and natural clay minerals. The polymers are understood here as meaning synthetic and natural polymers, and also modified polymers of natural origin. Among these substances, preference is in turn given to the natural clay minerals.

Of suitability are inter alia organic fatty acids having 8 to 22 carbon atoms, such as lauric acid, myristic acid, stearic acid or mixtures thereof. Furthermore, preference is given to organic polymers. The polymers may be of a nonionic, anionic, cationic or amphoteric nature. Natural polymers and modified polymers of natural origin are just as useful as synthetic polymers.

The group of nonionic polymers used with particular preference as binders include polyvinyl alcohols, acetalated polyvinyl alcohols, polyvinyl-pyrrolidones and polyalkylene glycols, in particular polyethylene oxides. Preferred polyvinyl alcohols and acetalated polyvinyl alcohols have molecular weights in the range from 10 000 to 100 000 g/mol, preferably from 11 000 to 90 000 g/mol, particularly preferably from 12 000 to 80 000 g/mol and especially preferably from 13 000 to 70 000 g/mol. Preferred polyethylene oxides have molar masses in the range from ca. 200 to 5 000 000 g/mol, corresponding to degrees of polymerization n of ca. 5 to >100 000.

The anionic polymers used with particular preference as binders are in particular homo- or copolymeric polycarboxylates. Preference is given to using, for example, polyacrylic acid or polymethacrylic acid, in particular that with a relative molecular mass of from 500 to 70 000 g/mol.

Among these, preference is given to polyacrylates which preferably have a molecular mass of from 2000 to 20 000 g/mol. On account of their superior solubility, from this group, preference is in turn given to the short-chain polyacrylates which have molar masses of from 2000 to 10 000 g/mol, and preferably from 3000 to 5000 g/mol.

Among these, preference is furthermore given to copolymeric poly-carboxylates, in particular those of acrylic acid with methacrylic acid and of acrylic acid or methacrylic acid with maleic acid. Copolymers of acrylic acid with maleic acid which comprise 50 to 90% by weight of acrylic acid and 50 to 10% by weight of maleic acid have proven to be particularly suitable. Their relative molecular mass, based on free acids, is preferably 2000 to 70 000 g/mol, particularly preferably 20 000 to 50 000 g/mol and especially preferably 30 000 to 40 000 g/mol.

To improve the solubility in water, the polymers can also contain structural units originating from allylsulfonic acids, such as, for example, allyloxy-benzenesulfonic acid and methallylsulfonic acid. Particular preference is also given to biodegradable polymers of more than two different monomer units, for example those which contain structural units from salts of acrylic acid and of maleic acid, and also from vinyl alcohol or vinyl alcohol derivatives and sugar derivatives or the structural units from salts of acrylic acid and of 2-alkylallylsulfonic acid and from sugar derivatives.

Further preferred copolymers are those which have structural units originating from acrolein and acrylic acid/acrylic acid salts and/or acrolein and vinyl acetate.

Further anionic polymers used preferably as binders are polymers containing sulfonic acid groups, in particular copolymers of unsaturated carboxylic acids, monomers containing sulfonic acid groups and optionally further ionogenic or nonionogenic monomers.

Further preferred binders are $C_8$-$C_{22}$-alcohol ethoxylates that are solid at room temperature, preferably $C_8$-$C_{22}$ alcohol ethoxylates having on average 10 to 100 ethylene oxide units in the molecule, such as e.g. Genapol® T 500 from Clariant or carboxymethylcelluloses.

Among the natural clay minerals, bentonite in particular is preferred.

Coating Layer and Coating Materials

The materials already used as binders (with the exception of the natural clay minerals such as, for example, bentonite) can also be used as coating materials. Here, the cogranules are coated following their production in a separate step with one or more coating materials such that a uniform protective layer is formed. In a preferred embodiment of the invention, their content in the overall granules is at least 10% by weight.

In a further preferred embodiment, the coating layer coats the granule core as completely and uniformly as possible.

The substances preferred as coating materials correspond to the aforementioned preferred binders (with the exception of the natural clay minerals such as, for example, bentonite). In a further preferred embodiment of the invention, the coating materials are therefore selected from fatty acids, alcohol ethoxylates and polymers. The polymers are understood here in turn as meaning synthetic and natural polymers, and also modified polymers of natural origin. Among the substances just specified, preference is in turn given to the fatty acids, in particular fatty acids having 8 to 22 carbon atoms.

Dyes

In a further preferred embodiment of the invention, the cogranules according to the invention comprise one or more dyes. Preferred dyes, the selection of which presents the person skilled in the art with no difficulty at all, have a high storage stability and insensitivity towards the other ingredients of the composition and to light, and also no marked substantivity toward the substrates to be treated with the dye-containing compositions, such as, for example, textiles, glass, ceramic or plastic dishes, so as not to stain them.

When selecting the dye, it must be ensured that the dyes have high storage stability and insensitivity toward light. At the same time, when selecting suitable dyes, it should also be taken into consideration that dyes have different stabilities toward oxidation. In general, water-insoluble dyes are more stable to oxidation than water-soluble dyes. The concentration of the dye in the detergents or cleaners varies depending on the solubility and thus also on the oxidation sensitivity. Preference is given to dyes which can be oxidatively destroyed in the washing process, and also mixtures thereof with suitable blue dyes, so-called bluing agents. It has proven to be advantageous to use dyes which are soluble in water or at room temperature in liquid organic substances. For example, anionic dyes, e.g. anionic nitroso dyes, are suitable.

Further Additives

Further additives which may be present in the cogranules according to the invention, particularly in their shell layer or coating layer, are additives which are known from the prior art for use in granules of this type, in particular in those intended for use in detergents and cleaners.

In a further preferred embodiment of the invention, the granule core of the cogranules according to the invention consists of the bleach activators of component a) and the binders of component c).

In a further preferred embodiment of the invention, the granule core of the cogranules according to the invention consists of the bleach activators of component a), the binders of component c) and organic acids.

In a further preferred embodiment of the invention, the shell layer or coating layer of the cogranules according to the invention consists of the bleach catalysts of component d) and the coating agents of component e).

In a further preferred embodiment of the invention, the shell layer or coating layer of the cogranules according to the invention consists of the bleach catalysts of component d), the coating agents of component e) and dyes.

In a further preferred embodiment of the invention, the cogranules according to the invention consist of the bleach activators of component a), the binders of component c), the bleach catalysts of component d), the coating agents of component e) and of one or more substances selected from organic acids present in the granule core of the cogranules according to the invention and dyes and further additives present in the shell layer or coating layer of the cogranules according to the invention.

Production of the Cogranules According to the Invention

Various granulation methods are in principle possible for providing the cogranules according to the invention.

In a first preferred variant, a build-up granulation takes place in mixing apparatuses. Here, the components are processed in customary, batch or continuous mixing devices which are generally equipped with rotating mixing elements. Mixers which can be used are moderate-intensity apparatuses such as e.g. plowshare mixers (Lödige KM types, Drais K-T types) but also high-intensity mixers (e.g. Eirich, Schugi, Lödige CB types, Drais K-TT types). For the mixing, all mixing variants are conceivable which ensure an adequate thorough mixing of the components. In a preferred embodiment, all components are mixed simultaneously. However, multistage mixing processes in which the individual components are introduced into the overall mixture in various combinations individually or together with other additives are also conceivable. The sequence of slow-speed and high-speed mixers can be swapped around, according to requirements. The residence times in the mixer granulation are preferably 0.5 s to 20 min, particularly preferably 2 s to 10 min. The granulation liquid can be pumped into the mixing apparatus via simple guide tubes. To improve distribution, however, nozzle systems (single-substance or multi-substance nozzles) are also conceivable.

Depending on the granulation liquid used (solvent or melt-like binder), the granulation stage is followed by a drying step (for solvents) or cooling step (for melts) in order to avoid an agglutination of the granules. The post-treatment preferably takes place in a fluidized-bed apparatus. The coarse fraction and the fines fraction are then separated off by screening. The coarse fraction is comminuted by grinding and is fed to another granulation process, as is the fines fraction.

Granulation with the Help of a Plasticizer

In a further preferred embodiment, the pulverulent constituents (bleach activator, bleach catalyst and optionally further auxiliaries) are admixed with one or more plasticizing substances. The plasticizers can be introduced as liquid or as melt, where melt-like substances are preferred according to the invention.

The liquid plasticizer is intensively mixed with the pulverulent active substance and optionally the further additives so that a plastically deformable mass is formed. The mixing step can take place in the aforementioned mixing apparatuses, although kneaders or specific types of extruders (e.g. Extrud-o-mix from Hosokawa-Bepex Corp.) are also conceivable. The granulation mass is then forced by means of tools through the die holes in a compression die to form cylindrically shaped extrudates. Suitable apparatuses for the extrusion process are annular edge-run presses (e.g. from Schlüter, Salmatec, Bühler), edge runners (e.g. from Amandus-Kahl) and extruders, designed as a single-shaft machine (e.g. from Hosokawa-Bepex, Fuji-Paudal) or preferably as a twin-screw extruder (e.g. from Händle). The choice of diameter for the die hole depends on the individual case and is typically in the range from 0.7-4 mm.

The emerging extrudates should be comminuted to the desired length and/or particle size by means of a post-processing step. In many cases, a length/diameter ratio of L/D=1 is desired. In the case of cylindrical granules, the particle diameter is between 0.2 and 2 mm, preferably between 0.5 and 0.8 mm, the particle length is in the range from 0.5 to 3.5 mm, ideally between 0.9 and 2.5 mm. The length and/or size adjustment of the granules can take place for example by means of fixed stripping knives, rotating cutting knives, cutting wires or cutting blades. To round the cut edges, the granule can subsequently be rounded once again in a rounder (e.g. from Glatt, Schlüter, Fuji-Paudal).

After the size of the granules has been established, a final consolidation step is required, in which the solvent is removed and/or the melt is solidified. Usually, this step is carried out in a fluidized-bed apparatus which is operated as a dryer or chiller depending on the requirements. The coarse fraction and the fines fraction are then separated off by screening. The coarse fraction is comminuted by grinding and fed to another granulation process, as is the fines fraction.

Compaction

In a further preferred embodiment, the pulverulent active substances are optionally mixed with further preferably solid additives, and this mixture is compacted, then ground and then optionally screened into individual particle fractions. If necessary, liquid additives can additionally also be added to the mixture to a certain extent (e.g. up to 10% by weight). Examples of compacting auxiliaries are waterglass, polyethylene glycols, nonionic surfactants, anionic surfactants, polycarboxylate copolymers, modified and/or unmodified celluloses, bentonites, hectorites, saponites and/or other detergent ingredients.

The compaction is preferably carried out on so-called roll compactors (e.g. from Hosokawa-Bepex, Alexanderwerk, Köppern). The choice of roller profile allows, firstly, pellets or briquettes in piece form, and, secondly, pressed slugs to be produced. Whereas the pressings in piece form usually only have to be removed from the fines fraction, the slugs have to be ground to the desired particle size in a mill. Typically, the mill types used are preferably gentle milling apparatuses, such as e.g. screening and hammer mills (e.g. from Hosokawa-Alpine, Hosokawa-Bepex) or roll mills (e.g. from Bauermeister, Bühler).

The fines fraction and, if necessary, the coarse fraction are removed from the granules produced in this way by screening. The coarse fraction is fed back to the mill; the fines fraction is fed back to the compaction. For classification of the granules, it is possible to use customary screening machines, such as e.g. tumble screens or vibration screens (e.g. from Allgaier, Sweco, Vibra).

Coating Methods:

The granules produced by one of the methods described above are provided in a second step with the so-called active coating. For this, the granules are coated with a film-forming substance in an additional step by methods known per se, the coating shell comprising one or more bleach catalysts and optionally further additives.

For a uniform distribution in the coating shell on the one hand, and better processing on the other hand, it can prove to be advantageous to comminute the bleach catalyst prior to its incorporation into the coating. The maximum particle size of the ground bleach catalyst that is to be established here is defined inter alia by the starting particle size of the bleach catalyst, the dimensions of the coating layer to be applied and the process conditions of the coating process. Typically, the maximum particle size of the bleach catalyst can be limited to <100 μm, preferably <50 μm.

If the grinding of the bleach catalyst is required, all customary grinding principles and grinding units are conceivable in principle. For example, an impact comminution can take place in a pin mill. Ultimately, the grinding properties of the bleach catalyst, such as e.g. brittleness, and the desired grinding fineness are determined primarily by the choice of mill.

In the next process step, the processed bleach catalyst is incorporated into the coating substance. For this, the coating liquid is introduced as initial charge in a container and the bleach catalyst is added with stirring. Depending on the fluid system, in the case of somewhat low-viscosity systems, stirring elements are advantageous to avoid the sedimentation of solids, or in the case of high-viscosity systems, mixers are advantageous for introducing shear energy.

As already mentioned above, the coating materials in a preferred embodiment of the invention are selected from fatty acids, alcohol ethoxylates and polymers.

In a further preferred embodiment of the invention, the coating materials are selected from film-forming substances, such as waxes, silicones, fatty acids, fatty alcohols, soaps, anionic surfactants, nonionic surfactants, cationic surfactants, anionic and cationic polymers, and also polyalkylene glycols. Preference is given to using coating substances with a melting point of 30-100° C. Examples thereof are: $C_8$-$C_{31}$-fatty acids, for example lauric acid, myristic acid, stearic acid; $C_8$-$C_{31}$-fatty alcohols; polyethylene glycols with a molar mass of from 1000 to 50 000 g/mol; fatty alcohol polyalkoxylates with 1 to 100 mol of EO (EO: ethylene oxide unit); alkanesulfonates, alkylbenzenesulfonates, α-olefinsulfonates, alkyl sulfates, alkyl ether sulfates with $C_8$-$C_{31}$-hydrocarbon radicals, polymers, for example polyvinyl alcohols, waxes, for example montan waxes, paraffin waxes, ester waxes, polyolefin waxes, silicones.

The coating substance which softens or melts in the range from 30 to 100° C. can moreover comprise, in dissolved or suspended form, further substances which do not soften or melt within this range, for example homo-, co- or graft copolymers of unsaturated carboxylic acids and/or sulfonic acids, and also alkali metal salts thereof, cellulose ethers, starch, starch ethers, polyvinylpyrrolidone; mono- and polybasic carboxylic acids, hydroxycarboxylic acids or ether carboxylic acids having 3 to 8 carbon atoms, and also salts thereof; silicates, carbonates, bicarbonates, sulfates, phosphates, phosphonates.

To apply the coating substances, mixers (mechanically induced fluidized bed) and fluidized-bed apparatuses (pneumatically induced fluidized bed) can be used. Possible mixers are e.g. plowshare mixers (continuous and batchwise), annular bed mixers or else Schugi mixers. When a mixer is used, the heating can take place in a granule preheater and/or in the mixer directly and/or in a fluidized bed downstream of the mixer. To cool the coated granules, granule coolers or fluidized-bed coolers can be used. In the case of fluidized-bed apparatuses, the heating takes place via the heating gas used for fluidization. The granules coated by the fluidized-bed process can, in a similar manner to the mixing process, be cooled via a granule cooler or a fluidized-bed cooler. Both during the mixing process and also during the fluidized-bed process, the coating substance can be sprayed on via a single-substance or a twin-substance nozzle device. The optional heating consists in a thermal treatment at a temperature of from 30 to 100° C., but at or below the melting or softening temperature of the particular coating substance. Preference is given to working at a temperature which is just below the melting or softening temperature.

Furthermore, the coating agents can be applied to the primary particle in the form of solutions or suspensions, which is possible in principle using the aforementioned apparatuses. Here, preference is given to using fluidized-bed apparatuses since these offer the advantage that liquid can be sprayed in and moisture can be dried off simultaneously. This often enables increased flexibility within the process and in the achievable product quality to be achieved.

A characteristic of the cogranules according to the invention is primarily their chemical composition. Equally, it has been found that the bleaching effect of these cogranules can also be influenced in an advantageous manner via the influence of physical parameters such as, for example, the particle size, the fines fraction, and also the bleach catalyst content of selected screen fractions.

Preferred cogranules according to the invention are for this reason characterized in that the cogranules have an average particle size between 0.1 and 1.6 mm, preferably between 0.2 and 1.2 mm and particularly preferably between 0.3 and 1.0 mm.

The cogranules according to the invention are suitable for use in all detergents or cleaners, where their use in compositions for machine dishwashing has proven to be particularly advantageous.

The present invention therefore also provides the use of cogranules according to the invention for producing detergents and cleaners and preferably compositions for machine dishwashing.

The present invention also further provides detergents and cleaners, preferably compositions for machine dishwashing, comprising cogranules according to the invention.

Preferred detergents and cleaners according to the invention, in particular the compositions for machine dishwashing, comprise the cogranules according to the invention in amounts between 0.1 and 10% by weight, preferably in amounts between 0.2 and 8% by weight and particularly preferably in amounts between 0.5 and 6% by weight.

The detergents and cleaners according to the invention, in particular the compositions for machine dishwashing, which may be in the form of granules, pulverulent or tablet-like solids, or else in liquid or pasty form, can in principle comprise all ingredients that are known and customary in such compositions apart from the cogranules according to the invention. The detergents and cleaners according to the invention, in particular the compositions for machine dishwashing, can in particular comprise builder substances, peroxygen compounds, enzymes, alkali carriers, surface-active surfactants, pH regulators, organic solvents and further auxiliaries, such as glass corrosion inhibitors, silver corrosion inhibitors and foam regulators.

Particularly preferred detergents and cleaners, in particular compositions for machine dishwashing, comprise i) 15 to 65% by weight, preferably 20 to 60% by weight, of a water-soluble builder component, j) 5 to 25% by weight, preferably 8 to 17% by weight, of a peroxygen compound, and k) 0.5 to 6% by weight of cogranules according to the invention, in each case based on the total composition. Such a composition is in particular of low alkalinity, i.e. its 1 percent strength by weight solution has a pH of from 8 to 11.5 and preferably from 9 to 11.

Water-Soluble Builder Component and Builder Substances

Suitable water-soluble builder components in the detergents and cleaners according to the invention, in particular the compositions for machine dishwashing, are in principle all builders that are customarily used in compositions of this type, for example alkali metal phosphates, which can be present in the form of their alkaline, neutral or acidic sodium or potassium, salts. Examples thereof are trisodium phosphate, trisodium diphosphate, disodium dihydrogendiphosphate, pentasodium triphosphate, so-called sodium hexametaphosphate, and also the corresponding potassium salts or mixtures of sodium salts and potassium salts. Their quantities can be in the range up to about 60% by weight, preferably from 5 to 20% by weight, based on the total composition. Further possible water-soluble builder components are, besides polyphosphonates and phosphonate alkyl carboxylates, for example organic polymers of native or synthetic origin of the polycarboxylate type, which act as co-builders especially in hard-water regions. For example, polyacrylic acids and copolymers of maleic anhydride and acrylic acid, and also the sodium salts of these polymeric acids are suitable. Standard commercial products are, for example, Sokalan™ CP 5, CP 10 and PA 30 from BASF. Polymers of native origin which can be used as cobuilders include, for example, oxidized starch and polyamino acids, such as polyglutamic acid or polyaspartic acid. Further possible water-soluble builder components are naturally occurring hydroxycarboxylic acids, such as, for example, mono-, dihydroxysuccinic acid, alpha-hydroxypropionic acid and gluconic acid. Preferred organic water-soluble builder components include the salts of citric acid, in particular sodium citrate. Anhydrous trisodium citrate and preferably trisodium citrate dihydrate are suitable as sodium citrate. Trisodium citrate dihydrate can be used as a finely-crystalline or coarsely-crystalline powder. Depending on the pH ultimately established in the detergents and cleaners according to the invention, in particular the compositions for machine dishwashing, the acids corresponding to the specified cobuilder salts may also be present.

Peroxygen Compounds

Preferred peroxygen compounds are perborates and percarbonates, in particular the corresponding sodium salts of these compounds.

Enzymes

The enzymes optionally present in the detergents and cleaners according to the invention, in particular the compositions for machine dishwashing, include proteases, amylases, pullulanases, cutinases and/or lipases, for example proteases such as BLAP™, Optimase™, Opticlean™, Maxacal™, Maxapem™, Durazym™, Purafect™, OxP, Esperase™ and/or Savinase™, amylases such as Termamyl™, Amylase-LT™, Maxamyl™, Duramyl™ and/or lipases such as Lipolase™, Lipomax™, Lumafast™ and/or Lipozym™. The enzymes used can be adsorbed to carrier substances and/or embedded in coating substances, in order to protect them against premature deactivation. They are present in the detergents and cleaners according to the invention, in particular the compositions for machine dishwashing, preferably in amounts up to 10% by weight and particularly preferably in amounts of from 0.05 to 5% by weight, where particular preference is given to using enzymes stabilized against oxidative degradation.

Alkali Carriers

The detergents and cleaners according to the invention, in particular the compositions for machine dishwashing, preferably comprise the customary alkali carriers, such as, for example, alkali metal silicates, alkali metal carbonates and/or alkali metal hydrogencarbonates. The alkali carriers usually used include carbonates, hydrogencarbonates and alkali metal silicates with an $SiO_2/M_2O$ (M=alkali metal atom) molar ratio of from 1:1 to 2.5:1. Alkali metal silicates can be present in amounts of up to 40% by weight, in particular from 3 to 30% by weight, based on the total composition. The alkali carrier system preferably used in the detergents and cleaners according to the invention, in particular in the compositions for machine dishwashing, is a mixture of carbonate and hydrogencarbonate, preferably sodium carbonate and sodium hydrogencarbonate, which may be present in an amount of up to 50% by weight and preferably from 5 to 40% by weight.

In a further preferred embodiment of the invention, 20 to 60% by weight of water-soluble organic builders, in particular alkali metal citrate, 3 to 20% by weight of alkali metal carbonate and 3 to 40% by weight of alkali metal disilicate, are present in the detergents and cleaners according to the invention, in particular the compositions for machine dishwashing.

Surfactants

Surfactants, in particular anionic surfactants, zwitterionic surfactants and preferably weakly foaming nonionic surfactants, can also optionally be added to the detergents and cleaners according to the invention, in particular the compositions for machine dishwashing, said surfactants serving to better detach greasy soilings, as wetting agents and, optionally in the course of the production of these compositions, as granulation auxiliaries. Their amount can be up to 20% by weight, preferably up to 10% by weight, and is particularly preferably in the range from 0.5 to 5% by weight. Usually, extremely low-foam compounds are used in particular in the compositions for machine dishwashing. These include preferably $C_{12}$-$C_{18}$-alkylpolyethylene glycol polypropylene glycol ethers having in each case up to 8 mol of ethylene oxide and propylene oxide units in the molecule. However, it is also possible to use other known low-foam nonionic surfactants, such as, for example, $C_{12}$-$C_{18}$-alkylpolyethylene glycol polybutylene glycol ethers having in each case up to 8 mol of ethylene oxide and butylene oxide units in the molecule, terminally capped alkyl polyalkylene glycol mixed ethers, and also the albeit foaming, but ecologically attractive $C_8$-$C_{14}$-alkyl polyglucosides with a degree of polymerization of about 1 to 4 and/or $C_{12}$-$C_{14}$-alkyl polyethylene glycols having 3 to 8 ethylene oxide units in the molecule. Likewise of suitability are surfactants from the family of glucamides, such as, for example, alkyl-N-methylglucamides, in which the alkyl moiety preferably originates from a fatty alcohol with a carbon chain length $C_6$-$C_{14}$. It is sometimes advantageous if the described surfactants are used as mixtures, for example the combination alkyl polyglycoside with fatty alcohol ethoxylates or glucamide with alkyl polyglycosides. The presence of amine oxides, betaines and ethoxylated alkylamines is also possible.

pH Regulators

To establish a desired pH which is not produced by itself by the mixture of the other components, the detergents and cleaners according to the invention, in particular the compositions for machine dishwashing, can comprise system- and environment-compatible acids, in particular citric acid, acetic acid, tartaric acid, malic acid, lactic acid, glycolic acid, succinic acid, glutaric acid and/or adipic acid, but also mineral acids, in particular sulfuric acid or alkali metal hydrogensulfates, or bases, in particular ammonium or alkali metal hydroxides. pH regulators of this type are present in the detergents and cleaners according to the invention, in particular the compositions for machine dishwashing, preferably not exceeding 10% by weight and particularly preferably from 0.5 to 6% by weight.

Organic Solvents

The organic solvents which can be used in the detergents and cleaners according to the invention, in particular the compositions for machine dishwashing, particularly if they are present in liquid or paste form, include alcohols having 1 to 4 carbon atoms, in particular methanol, ethanol, isopropanol and tert-butanol, dials having 2 to 4 carbon atoms, in particular ethylene glycol and propylene glycol, and also mixtures thereof and the ethers which can be derived from the specified compound classes. Water-miscible solvents of this type are present in the detergents and cleaners according to the invention, in particular in the compositions for machine dishwashing, preferably in an amount not exceeding 20% by weight and particularly preferably from 1 to 15% by weight.

Glass Corrosion Inhibitors

In order to prevent glass corrosion during the wash cycle, corresponding inhibitors can be used in the detergents and cleaners according to the invention, in particular the compositions for machine dishwashing. Crystalline layered silicates and/or zinc salts are particularly advantageous here. The crystalline layered silicates are sold for example by Clariant under the trade name Na-SKS, e.g. Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$) or Na-SKS-4 ($Na_2Si_4O_9.xH_2O$, makatite). Of these, Na-SKS-5 (alpha-$Na_2Si_2O_5$), Na-SKS-7 (beta-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), but in particular Na-SKS-6 (delta-$Na_2Si_2O_5$) are primarily suitable. An overview of crystalline sheet silicates can be found e.g. in the article published in "Seifen-Öle-Fette-Wachse, volume 116, No. 20/1990" on pages 805-808.

In a further preferred embodiment of the invention, the detergents and cleaners according to the invention, in particular the compositions for machine dishwashing, have an amount of the crystalline layered silicate of preferably 0.1 to 20% by weight, particularly preferably 0.2 to 15% by weight and particularly preferably 0.4 to 10% by weight, in each case based on the total weight of these compositions.

To suppress the glass corrosion, detergents and cleaners according to the invention, in particular the compositions for machine dishwashing, can comprise at least one zinc or bismuth salt, preferably selected from the group of organic zinc salts, particularly preferably selected from the group of soluble organic zinc salts, especially preferably selected from the group of soluble zinc salts of monomeric or polymeric organic acids and extraordinarily preferably selected from the group consisting of zinc acetate, zinc acetylacetonate, zinc benzoate, zinc formate, zinc lactate, zinc gluconate, zinc oxalate, zinc ricinoleate, zinc abietate, zinc valerate and zinc p-toluenesulfonate. Alternatively or in combination with these zinc salts, bismuth salts, such as e.g. bismuth acetate, can be used.

Within the context of the present invention, preference is given here to detergents and cleaners according to the invention, in particular compositions for machine dishwashing, in which the amount of the zinc salt, based on the total weight of this composition, is 0.1 to 10% by weight, preferably 0.2 to 7% by weight and particularly preferably 0.4 to 4% by weight, irrespective of which zinc salts are used, but especially irrespective of whether organic or inorganic zinc salts, soluble or insoluble zinc salts or mixtures thereof are used.

Silver Corrosion Inhibitors

In order to effect silver corrosion protection, silver corrosion inhibitors can be used in detergents and cleaners according to the invention, in particular the compositions for machine dishwashing. Preferred silver corrosion inhibitors are organic sulfides such as cystine and cysteine, di- or trihydric phenols, optionally alkyl- or aryl-substituted triazoles, such as benzo-triazole, isocyanuric acid, titanium, zirconium, hafnium, cobalt and cerium salts and/or complexes in which the specified metals are present in one of the oxidation states II, III, IV, V or VI, depending on the metal.

Foam Regulators

If the detergents and cleaners according to the invention, in particular the compositions for machine dishwashing, for example in the presence of anionic surfactants, foam too much upon use, up to 6% by weight, preferably about 0.5 to 4% by weight, of a foam-suppressing compound, preferably from the group of silicone oils, mixtures of silicone oil and hydrophobicized silica, paraffins, paraffin/alcohol combinations, hydrophobicized silica, bis fatty acid amides, and other known commercially available antifoams can also be added to them.

The detergents and cleaners according to the invention, in particular the compositions for machine dishwashing, can comprise, as further ingredients, sequestrants, electrolytes, additional peroxygen activators, dyes or fragrances such as, for example, perfume oils, known for example from the prior art for compositions of this type.

Production of the Detergents and Cleaners According to the Invention

The production of the solid detergents and cleaners according to the invention, in particular compositions for machine dishwashing, presents no difficulties and can take place in a manner known in principle, for example by spray-drying or granulation, where peroxygen compound and cogranules according to the invention are optionally added separately at a later stage.

Detergents and cleaners according to the invention in the form of aqueous solutions or solutions containing other customary solvents, in particular corresponding compositions for machine dishwashing, are produced particularly advantageously by simply mixing the ingredients, which can be added to an automatic mixer without dilution or in the form of a solution.

The detergents and cleaners according to the invention, in particular compositions for machine dishwashing, are preferably in the form of pulverulent, granular or tabletted preparations, which can be produced in a manner known per se, for example by mixing, granulation, roll compaction and/or by spray-drying the thermally stressable components and admixing the more sensitive components, which include in particular enzymes, bleaches and the bleach catalyst.

The procedure for producing detergents and cleaners according to the invention, in particular compositions for machine dishwashing, in tablet form preferably involves mixing together all of the constituents in a mixer and compressing the mixture by means of conventional tabletting presses, for example eccentric presses or rotary presses, with compression pressures in the range from $200 \cdot 10^5$ to $1500 \cdot 10^5$ Pa.

This produces fracture-resistant tablets which nevertheless have sufficiently rapid solubility under use conditions and have flexural strengths of normally more than 150 N without any problem. A tablet produced in this way preferably has a weight of 15 to 40 g, in particular from 20 to 30 g, for a diameter of 35 to 40 mm.

Detergents and cleaners according to the invention can be produced in the form of non-dusting powders which have stable free flowability in the course of storage, and/or granules with high bulk densities in the range from 800 to 1000 g/l, in particular corresponding compositions according to the invention for machine dishwashing, by, in a first part stage of the process, mixing the builder components with at least some liquid mixing components to increase the bulk density of this premix, and then—if desired after an interim drying—combining the further constituents of the composition, including the cogranules according to the invention, with the premix obtained in this way.

Compositions according to the invention for machine dishwashing can be used both in domestic dishwashers and in commercial dishwashers. The addition takes place by hand or by means of suitable dosing devices. The use concentrations in the cleaning liquor are generally about 1 to 8 g/l, preferably 2 to 5 g/l.

A machine rinse program is generally supplemented and completed by a number of intermediate rinse cycles, which follow the wash cycle and use clear water, and a clear-rinse cycle with a conventional rinse aid. After drying, when compositions according to the invention are used, completely clean and hygienically impeccable dishes are obtained.

EXAMPLES

Hereinbelow, unless explicitly stated otherwise, % data are percentages by weight (% by weight). As regards the stated relative atmospheric humidities, the % data have the customary meaning.

The industrially available bleach activator TAED (tetraacetylethylenediamine), was acquired from Clariant in powder form, the manganese salts were acquired from Sigma-Aldrich and the metal complexes used were produced in accordance with literature.

Example 1

Production of Cogranules According to the Invention with an Active Coating

These are cogranules comprising TAED and a bleach catalyst, such as e.g. Mn(II) sulfate, which is applied separately as an active coating. Additionally, the cogranules comprise the required granulation auxiliaries, such as binder and coating substance, but optionally also further additives such as e.g. stabilizers.

To prepare the active coating, stearic acid as shell substance or coating agent is introduced into a stirred container at T=95° C. and melted. The bleach catalyst is introduced into the stirred melt and distributed evenly. The bleach catalyst was comminuted beforehand in a laboratory mill.

As base granules for the active coating, TAED granules (Peractive CB—commercial product of Clariant comprising bentonite) are introduced into a laboratory mixer. The granules are heated under moderate stirring to the required starting temperature of T>70° C. At a somewhat increased stirring rate, the melt mixture containing the bleach catalyst is metered in evenly and slowly such that the mixture is spread uniformly on the base granules and excessive application by granulation is avoided. After applying the desired amount of melt mixture, the coated granules are briefly mixed, emptied from the mixer and cooled. The product is then screened to separate coarse fractions and fines fractions of 200-1600 μm.

In the case of the cogranules A according to the invention, instead of using Peractive CB, firstly TAED, bentonite and oxalic acid are mixed and then granulated, and the resulting granules are coated.

Table 1 shows an overview of the produced inventive cogranules with an active coating which were provided for further investigations.

TABLE 1

| Inventive cogranules with an active coating | | | | |
|---|---|---|---|---|
| Cogranules example | A | B | C | D |
| Substances | | | | |
| Bleach activator | TAED | TAED | TAED | TAED |
| Bleach catalyst | Mn(II) sulfate | Mn(II) sulfate | Complex 1 | Complex 2 |
| Bleach activator: bleach catalyst | 8.3:1 | 7.7:1 | 11.5:1 | 11.5:1 |

TABLE 1-continued

| Inventive cogranules with an active coating | | | | |
|---|---|---|---|---|
| Cogranules example | A | B | C | D |
| Binder | Bentonite | Bentonite | Bentonite | Bentonite |
| Organic acid | Oxalic acid | — | — | — |
| Coating agent | Stearic acid | Stearic acid | Stearic acid | Stearic acid |
| Dye in the coating | — | — | — | Red |
| Composition | | | | |
| Bleach activator % | 70.08 [K; 84.3] | 74.32 [K; 92.0] | 75.18 [K; 90.8] | 74.88 [K; 91.2] |
| Bleach catalyst % | 8.41 [H; 50.0] | 9.61 [H; 50.0] | 6.54 [H; 38.0] | 6.51 [H; 36.4] |
| Binder % | 6.09 [K; 7.3] | 6.46 [K; 8.0] | 7.62 [K; 9.2] | 7.26 [K; 8.8] |
| Organic acid % | 7.01 [K; 8.4] | — | — | — |
| Coating agent % | 8.41 [H; 50.0] | 9.61 [H; 50.0] | 10.66 [H; 62.0] | 11.05 [H; 61.9] |
| Dye | — | — | — | 0.30 [H; 1.7] |
| Core: shell [weight ratio] | 83.2:16.8 | 80.8:19.2 | 82.8:17.2 | 82.1:17.9 |

TAED tetraacetylethylenediamine

Complex 1 $[Mn^{IV}_2(\mu\text{-}O)_3(Me\text{-}TACN)_2](PF_6)_2$, prepared as in EP 0 458 397

Complex 2 1,8-diethyl-1,4,8,11-tetraazacyclotetradecanemanganese(II) chloride, prepared as in EP 1 557 457

Table 1 gives both the amount of the ingredients based on the total cogranules according to the invention in % by weight, and also the amount of the respective ingredients in % by weight, either based on the total granule core or on the total shell layer or coating layer, depending on in which part of the cogranules according to the invention the corresponding ingredient is present. Here, the statement "[K; 84.3]" for the bleach activator of cogranules A means that the bleach activator is present in the granule core and its amount—based only on the total mass of the granule core—is 84.3% by weight. Accordingly, for example the statement "[H; 50.0]" for the bleach catalyst of cogranules A means that the bleach catalyst is present in the shell layer or coating layer and its amount—based only on the total mass of the shell layer or coating layer—is 50.0% by weight.

Example 2

Hygroscopicity Test—Physical Stability

To investigate the physical stability of the cogranules according to the invention, the hygroscopic behavior is investigated at increased relative humidity. For this, the cogranules are stored for several hours open at a relative humidity of 65% and room temperature. Over the experiment time, the moisture absorption is registered via a balance and the external change in the sample is observed. At the end of the storage experiment, as well as the weight increase, also the pourability and/or the degree of caking is assessed by reference to grades (grade 1: very good, freely pourable to grade 6: completely caked, no longer pourable).

Table 2 shows the results of the hygroscopicity test for the cogranules described above.

TABLE 2

| Hygroscopicity test<br>Hygroscopicity-65% rH | | | | |
|---|---|---|---|---|
| Cogranules example | A | B | C | D |
| Moisture absorption % | 1.5 | 1.8 | 3.3 | 2.5 |
| Grade (pourability) | 1 | 1 | 1 | 1 |
| Assessment of granules | Very good | Very good | Very good | Very good |

rH: relative humidity

The results show that the cogranules according to the invention remain pourable despite a discernible moisture absorption of >1.5% and do not cake under the effect of increased humidity.

Example 3

Storage Experiments in Base Washing Powders—Chemical Storage Stability

To investigate the physical stability of the cogranules according to the invention, the storage behavior is investigated in a typical washing powder formulation. For this, the coated cogranules are incorporated into IEC-A base washing powder such that the finished formulation comprises 5% of cogranules according to the invention. The mixtures are then stored for several days at room climate and intensified climatic conditions (T=40° C., 75% relative humidity). At regular intervals, the samples are assessed as regards discoloration of the cogranules and graded (grade 1: very good, no discoloration, to grade 6: severe discoloration, very dark color).

Table 3 shows the results of the storage experiment in base washing powders for the cogranules described above.

TABLE 3

| Storage experiment in base washing powder<br>Storage stability in base washing powder IEC-A | | | | |
|---|---|---|---|---|
| Cogranules example | A | B | C | D |
| Storage time at room climate [days] | 20 | 20 | 13 | 13 |
| Grade (discoloration) | 2 | 1 | 1 | 2 |
| Evaluation of sample | Good | Very good | Very good | Good |
| Storage time at 40° C., 75% rH [days] | 20 | 20 | 13 | 13 |
| Grade (discoloration) | 2 | 2 | 3 | 3 |
| Evaluation of sample | Good | Good | Acceptable | Acceptable |

rH: relative humidity

The results show that all of the investigated cogranules according to the invention have a good to very good storage stability both at room climate and also under intensified climatic conditions. The active coating therefore also offers the advantage of increased storage stability, meaning that impairment as a result of an adverse color change in the cogranules according to the invention was able to be avoided.

The invention claimed is:

1. A cogranule comprising a granule core and a shell layer or coating layer surrounding the granule core, wherein the granule core comprises a) at least one bleach activator, and c) at least one binder and wherein the shell layer or coating layer comprises d) at least one transition metal bleach catalyst and e) at least one coating agent selected from the group consisting of fatty acids, alcohol ethoxylates, and polymers, and the weight ratio of granule core to shell layer or coating layer is from 95:5 to 50:50, further wherein 0% by weight of the total amount of the at least one transition metal bleach catalyst in the cogranule is present in the core, and 100% by weight of the total amount of the at least one transition metal bleach catalyst in the cogranule is present in the shell layer or coating layer.

2. A cogranule as claimed in claim wherein the granule core comprises a) 1 to 99% by weight of at least one bleach activator and c) 0.9 to 30% by weight of at least one binder and the shell layer or coating layer comprises d) 1 to 99% by weight of at least one transition metal bleach catalyst and e) 1 to 99% by weight of at least one coating agent.

3. A cogranule as claimed in claim 1, wherein the granule core comprises a) 50 to 95% by weight of at least one bleach activator and c) 4.9 to 20% by weight of at least one binder and the shell layer or coating layer comprises d) 2 to 60% by weight of at least one transition metal bleach catalyst and e) 40 to 98% by weight of at least one coating agent.

4. A cogranule as claimed in claim 1, wherein the weight ratio of granule core to shell layer or coating layer is from 90:10 to 60:40.

5. A cogranule as claimed in claim 1, wherein the at least one bleach activator is selected from the group consisting of tetraacetylethylenediamine and decanoyloxybenzoic acid.

6. A cogranule as claimed in claim 1, wherein the at least one transition metal bleach catalyst is selected from the group consisting of manganese salts and manganese complexes.

7. A cogranule as claimed in claim 1, wherein the at least one binder is selected from the group consisting of fatty acids, alcohol ethoxylates, polymers and natural clay minerals.

8. A process for producing detergents and cleaners comprising the step of adding a cogranule as claimed in claim 1 to the detergents and cleaners.

9. A process for producing compositions for machine dishwashing comprising the step of adding a cogranule as claimed in claim 1 to the compositions for machine dishwashing.

10. A cogranule as claimed in claim 1, wherein the at least one coating agent is a fatty acid.

11. A cogranule as claimed in claim 1, wherein the at least one binder is a natural clay mineral.

* * * * *